US009550650B2

(12) United States Patent
Matsushima et al.

(10) Patent No.: US 9,550,650 B2
(45) Date of Patent: Jan. 24, 2017

(54) TRAVERSE DEVICE AND TRAVERSE METHOD

(71) Applicants: Hidenori Matsushima, Ono (JP); Setsuo Tsunemine, Ono (JP)

(72) Inventors: Hidenori Matsushima, Ono (JP); Setsuo Tsunemine, Ono (JP)

(73) Assignee: TOKUSEN KOGYO CO., LTD., Ono, Hyogo (JP)

( * ) Notice: Subject to any disclaimer, the term of this patent is extended or adjusted under 35 U.S.C. 154(b) by 271 days.

(21) Appl. No.: 14/347,659

(22) PCT Filed: Sep. 20, 2012

(86) PCT No.: PCT/JP2012/074052

§ 371 (c)(1),
(2) Date: Mar. 27, 2014

(87) PCT Pub. No.: WO2013/047317

PCT Pub. Date: Apr. 4, 2013

(65) Prior Publication Data

US 2015/0048196 A1 Feb. 19, 2015

(30) Foreign Application Priority Data

Sep. 27, 2011 (JP) ..... 2011-210616

(51) Int. Cl.
*B65H 54/32* (2006.01)
*B65H 54/28* (2006.01)

(52) U.S. Cl.
CPC ..... *B65H 54/325* (2013.01); *B65H 54/2803* (2013.01); *B65H 54/283* (2013.01); *B65H 54/2848* (2013.01); *B65H 2404/741* (2013.01); *B65H 2404/742* (2013.01); *B65H 2701/36* (2013.01)

(58) Field of Classification Search
CPC . B65H 54/28; B65H 54/2803; B65H 54/2818; B65H 54/2821; B65H 54/283; B65H 54/2833; B65H 54/2848; B65H 54/325; B65H 57/006; B65H 2404/741; B65H 2404/742; B65H 2701/36
See application file for complete search history.

(56) References Cited

U.S. PATENT DOCUMENTS

2015/0321874 A1* 11/2015 Tsunemine ..... B65H 54/2803 242/476.7

FOREIGN PATENT DOCUMENTS

JP 54-118954 A 9/1979
JP 56-082768 A 7/1981
(Continued)

*Primary Examiner* — William E Dondero
(74) *Attorney, Agent, or Firm* — Browdy and Neimark, PLLC

(57) ABSTRACT

A traverse device and a traverse method for winding wire materials are provided. A guide roller is placed near the outer circumference of a reel body and inclined, around the rotation center (center of curvature of an R guide) located near the outer edge of the guide roller on the side near the reel body as the fulcrum, in a direction in which the roller outer edge recedes from one of reel flanges ahead in the traverse direction on the side apart from the reel body. The inclining direction is switched at the midpoint position between the reel flanges, and with the guide roller being inclined at all times, a reel is rotated while being moved in the axis direction to wind a wire material on the reel.

4 Claims, 4 Drawing Sheets

(56) References Cited

FOREIGN PATENT DOCUMENTS

| | | | |
|---|---|---|---|
| JP | 04-020460 | A | 1/1992 |
| JP | 2001-180866 | A | 7/2001 |
| JP | 2011210616 | A | 10/2011 |

* cited by examiner

Figure 2 ( a )
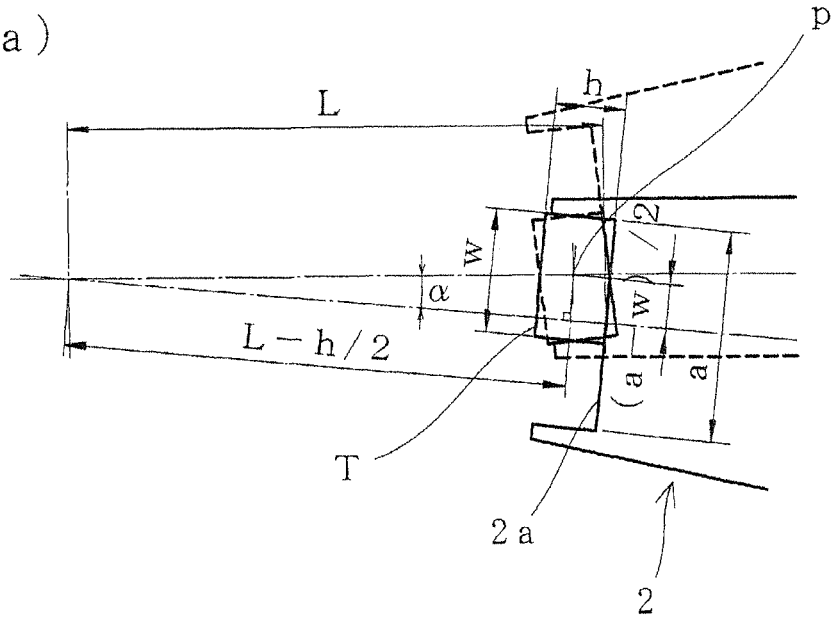
Figure 2 ( b )
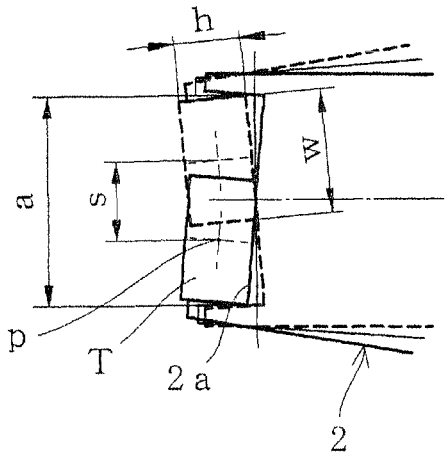

Figure 3 ( a )
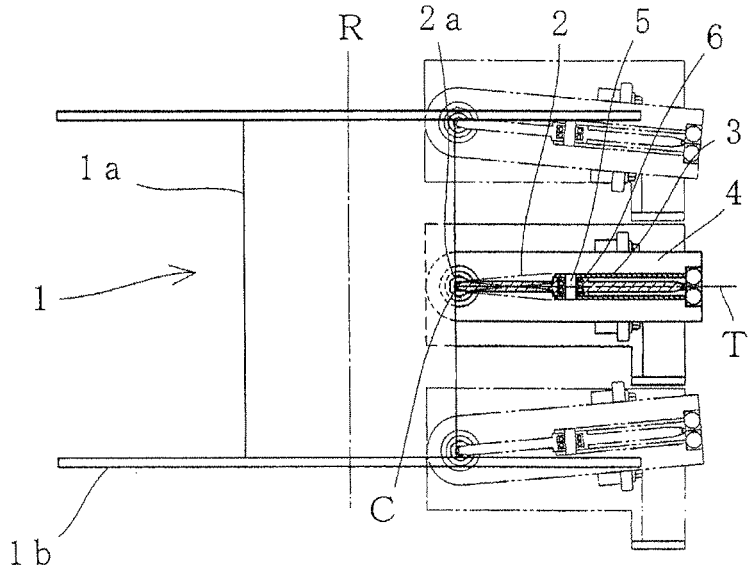
Figure 3 ( b )
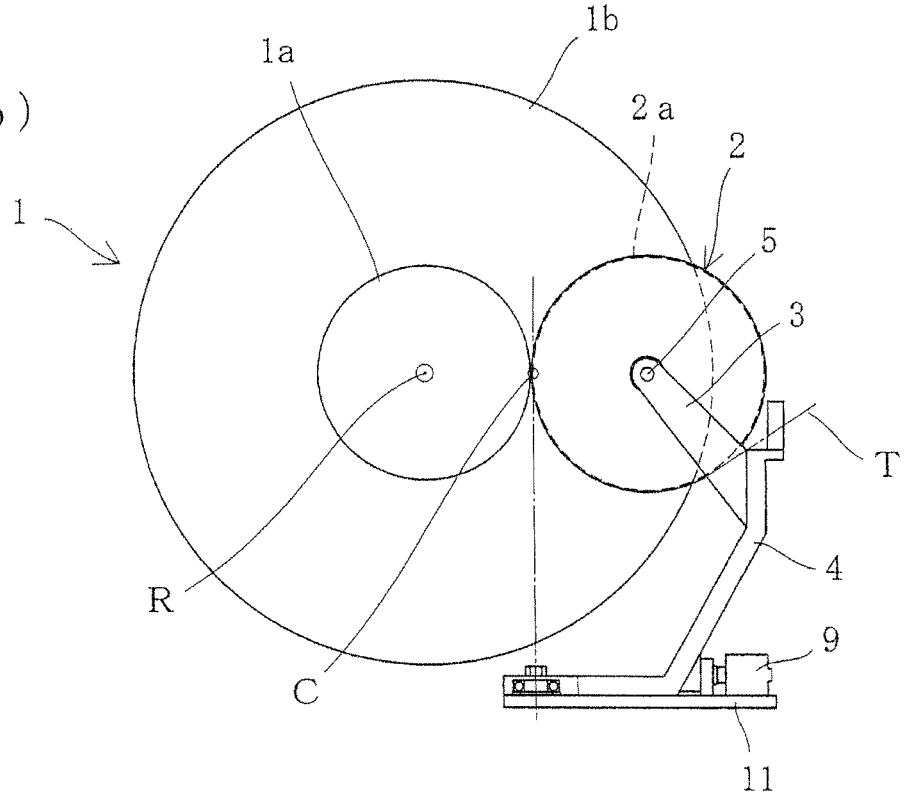

TRAVERSE DEVICE AND TRAVERSE METHOD

TECHNICAL FIELD

The present invention relates to a traverse device and a traverse method for winding wire materials including metal wires such as steel cords, bead wires, and wires for piston rings, coated wires such as electric cables, and other materials such as ropes by regular winding.

BACKGROUND ART

As a method for winding a wire material on a reel, the following method is conventionally known: a wire material to be wound is guided to a reel body via a guide roller spaced radially from the reel body, and wound by rotating the reel while moving the reel or the guide roller in the reel axis direction to move (traverse) the winding position.

According to this method, the wire material can be wound on the reel by regular winding by repeating the operation of reciprocating the reel or the guide roller in the reel axis direction at a predetermined pitch every time the wire material is wound around the reel body by one round. In this method, however, since there is a distance between the reel body and the guide roller, a deviation arises between the movement of the winding position of the wire material on the reel body and the movement of the reel or the guide roller. For this reason, traverse adjustment at the reversal of the movement at both ends of the reel body, in particular, is not easy.

A method may be considered in which a large-diameter guide roller is used and placed to locate the roller outer edge near the reel body on the reel side, to make the movement of the winding position of the wire material on the reel body coincide with the movement of the reel or the guide roller. In this method, however, when the wire material to be wound is fine, the roller width must be small to ensure that the wire material can be wound up to the borders of the guide roller body with the flanges and that the wire material is prevented from swaying and causing deviation of the pitch. There is therefore the possibility of failing to maintain the strength of the guide roller sufficiently.

Also proposed is a method in which the guide roller is placed so as to be inclinable in the reel axis direction around a rotational axis, as the rotation center, located at the roller outer edge on the side apart from the outer circumference of the reel body. At the time of traverse reversal near the border of the reel body with the flange at either end, the movement of the reel in the axis direction is stopped, and, while the guide roller is angled and inclined so that the roller outer edge comes close to the flange border on the reel side, the reel is rotated to wind the wire material on the reel body at the flange border. At the midpoint position of the reel body, while the reel is moved continuously in the axial direction at a fixed speed, the guide roller is angled so as to wind the wire material on the reel by one round at a time (see Patent Document 1, for example). According to this method, the guide roller is inclined at both ends of the reel body to enable winding of the wire material up to the flange border. Therefore, the roller width can be large enough to maintain its necessary strength.

In the above method, however, not only at the time of traverse reversal, but also at the midpoint position of the reel body, it is necessary to move the rotational axis of the guide roller forward or backward with respect to the reel body in response to the inclination so that the guide roller is not apart from the reel, and this makes the control complicated. Also, with the inclination of the guide roller, the pitch of the traverse changes when the reel moves at a constant speed, for example. For this reason, in order to keep the pitch of the traverse constant, pitch adjustment is necessary for the reel or the guide roller every time the guide roller is angled. This control is complicated and costly.

To solve the above problem, the following method has been considered. As in the above method, the guide roller is placed so as to be inclinable in the reel axis direction around the rotational axis, as the rotation center, located at the roller outer edge on the side apart from the outer circumference of the reel body, and the roller outer edge is inclined to be close to the reel flange located ahead in the traverse direction on the side near the reel body. In this method, however, the inclining direction of the guide roller is switched to the opposite direction at the midpoint position of the reel body, and the guide roller is inclined at all times except for this switching time. With the guide roller inclined in this way, while the traverse is performed by the movement of the reel in the axis direction, for example, the reel is rotated to wind the wire material thereon. FIG. 4 shows a configuration of a main part of a traverse device used in this method.

In FIG. 4, the reference numeral 1 denotes a reel, 1*a* denotes a reel body, 1*b* denotes a reel flange, 2 denotes a guide roller, 2*a* denotes a guide groove on the outer circumference of the guide roller, 3 denotes a support arm that supports the guide roller, and 4 denotes a support block to which the support arm 3 is secured.

The guide roller 2 is placed at a position where the outer edge (roller outer edge) is near the reel body 1*a* on the side near the reel 1, and is rotatably supported via a bearing 6 by a roller shaft 5 secured to the support arm 3.

The support block 4 is placed on a movable mount (not shown) that is movable along a linear guide rail (not shown) formed on a base (not shown) in a direction orthogonal to the axis direction of the reel 1 using an air cylinder (not shown) for horizontal movement as the drive source, and is rotatable along an arc-shaped guide rail (not shown) around a rotation center C set at the outer edge of the guide roller 2 supported by the support arm 3 on the side apart from the outer circumference of the reel body 2*a* as the axis, using an air cylinder (not shown) for rotational movement as the drive source.

The support block 4 is movable and rotatable as described above. When the support block 4 rotates around the rotation center C, the guide roller 2 rotates around the rotation center C from its reference position (shown by the solid line in FIG. 4) vertical to the reel axis direction to either of inclined positions (shown by the dashed-two dotted line in FIG. 4) inclined by several degrees to both sides in the reel axis direction. Also, when the support block 4 moves, the guide roller 2 moves in the direction in which the roller outer edge comes close to or recedes from the reel body 1*a* on the side near the reel 1.

In the above device, the traverse (movement of the winding position) is performed by moving the reel 1 in the reel axis direction (up/down direction in FIG. 4) using an air cylinder (not shown) for reel movement as the drive source. During the traverse, when the guide roller 2 is located in the center in the reel axis direction, for example, that is the midpoint position of the reel body 1*a*, the inclining direction of the guide roller 2 is switched, to incline the guide roller 2 in a direction in which the outer edge of the guide roller 2 comes close to the reel flange 1*b* ahead in the traverse direction on the side near the reel body 1*a*. With the guide roller 2 kept inclined in this way, the reel 1 is rotated while being moved in the axial direction, to wind the wire material T on the reel body 1*a*.

According to the method described above, where the traverse is performed with the guide roller being inclined at all times, it is unnecessary to move the guide roller forward or backward in response to the inclination of the guide roller. Also, since the inclining direction of the guide roller does not change during one round of traverse, control of pitch adjustment is comparatively easy.

PRIOR ART DOCUMENT

Patent Document

[Patent Document 1] JP 2001-180866A

SUMMARY OF INVENTION

Technical Problem

As described above, according to the method where the traverse is performed with the guide roller 2 being inclined in the reel axis direction at all times, it is unnecessary to move the guide roller 2 forward or backward with respect to the reel body 1*a* in response to the inclination of the guide roller 2, and the inclining direction of the guide roller does not change during one round of traverse. Therefore, control for adjustment of the traverse pitch is comparatively easy. However, in this case, also, the inclining direction of the guide roller 2 is switched every round of traverse, and at this switching, the guide roller 2 rotates around the rotation center C located at the roller outer edge on the side apart from the outer circumference of the reel body 2*a*, to switch its position from one to the other of the positions shown by the dashed-two dotted line in FIG. 4. Therefore, the winding position of the wire material W to be wound on the reel body 1*a* is slightly deviated in the reel axis direction, changing the traverse pitch. For this reason, in order to stabilize the pitch, control of moving the reel 1 or the guide roller 2 in the reel axis direction is necessary, which is not easy.

An object of the invention is to solve this problem and make it possible to perform regular winding of a wire material by a simple means easily and inexpensively.

Solution to Problem

A traverse device of the invention according to a first aspect is a traverse device for winding a wire material fed via a guide roller having a guide groove on its outer circumference on a reel while moving a winding position of the wire material with respect to the reel in a reel axis direction, wherein the guide roller is placed near an outer circumference of a body of the reel, and inclined, around a rotation center located near a roller outer edge on the side near the outer circumference of the reel body as the fulcrum, in a direction in which the roller outer edge recedes from one of reel flanges located ahead in a traverse direction on the side apart from the reel body, the inclining direction is switched at a midpoint position between the reel flanges, and the reel or the guide roller is reciprocated in the reel axis direction to move the winding position with the guide roller being inclined at all times except for the switching time.

According to the device described above, the wire material can be wound up to the reel flange borders of the reel body while wobbling of the wire material being prevented or reduced with the guide roller being in an inclined position. Therefore, even when the wire material to be wound is fine, it is unnecessary to reduce the roller width excessively, and thus the guide roller can maintain its necessary strength. Also, since the traverse is performed with the guide roller being inclined at all times except for the switching time, it is unnecessary to move the guide roller forward or backward with respect to the reel body in response to the inclination of the guide roller. In addition, the inclining direction of the guide roller does not change during one round of traverse. Even when the inclining direction of the guide roller is switched at the midpoint position of the reel body, the wire material is prevented from largely deviating in the width direction of the guide groove because the guide roller is inclined around the rotation center located near the roller outer edge on the side near the outer circumference of the reel body as the fulcrum. The traverse pitch can therefore be kept roughly constant, and control of pitch adjustment is comparatively easy. Thus, the regular winding of the wire material can be performed easily and inexpensively.

A traverse device of the invention according to a second aspect is based on the traverse device according to the first aspect, wherein the rotation center for inclination is movable, toward the reel axis, to a position where a distance L between the rotation center and the bottom surface of the guide groove on the outer circumference of the guide roller satisfies $L=(a-w)/(2 \tan \alpha)+h/2$ where a is the width of the guide groove on the outer circumference of the guide roller, w is the width of the wire material to be wound, h is the depth of the guide groove, and $\alpha$ is the inclined angle of the guide roller, in a direction vertically crossing the reel axis.

According to the device described above, the wire material is wound up to the reel flange borders of the reel body while wobbling of the wire material is prevented or reduced with the guide roller being in an inclined position. Therefore, even when the wire material to be wound is fine, it is unnecessary to reduce the roller width excessively, and thus the guide roller can maintain its necessary strength. Also, since the traverse is performed with the guide roller being inclined at all times except for the switching time, it is unnecessary to move the guide roller forward or backward with respect to the reel body in response to the inclination of the guide roller. In addition, the inclining direction of the guide roller does not change during one round of traverse. Moreover, by setting the guide roller at a position where the distance L between the rotation center for inclination and the bottom surface of the guide groove on the outer circumference of the guide roller satisfies $L=(a-w)/(2 \tan \alpha)+h/2$ where a is the width of the guide groove, w is the width of the wire material, h is the depth of the guide groove, and $\alpha$ is the inclined angle of the guide roller, even when the inclining direction of the guide roller is switched at the midpoint position of the reel body, the wire material is prevented from deviating in the width direction of the guide groove. The traverse pitch can therefore be kept constant, and control of pitch adjustment is easy. Thus, the regular winding of the wire material can be performed easily and inexpensively.

A traverse method of the invention according to a third aspect uses the traverse device according to the first aspect, wherein the guide roller is inclined in a direction in which the roller outer edge recedes from a reel flange located ahead in the traverse direction on the side apart from the reel body, the inclining direction is switched at the midpoint position of the reel body, and while the reel or the guide roller is reciprocated in the reel axis direction to move the winding position with the guide roller being inclined at all times except for the switching time, the wire material is wound on the reel. By this method, the regular winding of the wire material can be performed easily and inexpensively.

A traverse method according to the fourth aspect of the invention uses the traverse device according to the second aspect, wherein the rotation center is set to a position where the distance L between the rotation center and the bottom surface of the guide groove on the outer circumference of the guide roller satisfies $L=(a-w)/(2 \tan \alpha)+h/2$ where a is the width of the guide groove on the outer circumference of the guide roller, w is the width of the wire material to be wound, h is the depth of the guide groove, and $\alpha$ is the inclined angle of the guide roller, the guide roller is inclined in a direction in which the roller outer edge recedes from a reel flange located ahead in the traverse direction on the side apart from the reel body, the inclining direction is switched at the midpoint position of the reel body, and, while the reel or the guide roller is reciprocated in the reel axis direction to move the winding position with the guide roller being inclined at all times except for the switching time, the wire material is wound on the reel. By this method, the regular winding of the wire material can be performed easily and inexpensively.

Advantageous Effects of Invention

As is apparent from the above description, according to the present invention, the regular winging of a wire material can be performed by a simple means easily and inexpensively.

BRIEF DESCRIPTION OF THE DRAWINGS

FIGS. 2(*a*) and 2(*b*) are views explaining the operation of the traverse device of the embodiment of the invention.

FIGS. 3(*a*) and 3(*b*) are a plan view and a side view, respectively, showing a configuration of a main part of another example of the traverse device of the embodiment of the invention.

DESCRIPTION OF EMBODIMENTS

Figure 1:
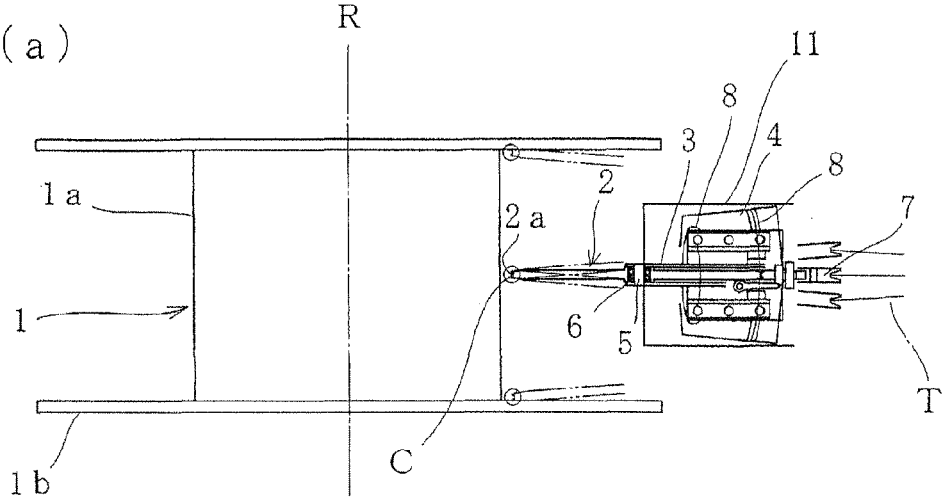
FIGS. 1(*a*) and 1(*b*) are a plan view and a side view, respectively, showing a configuration of a main part of a traverse device of an embodiment of the invention.
Figure 1:
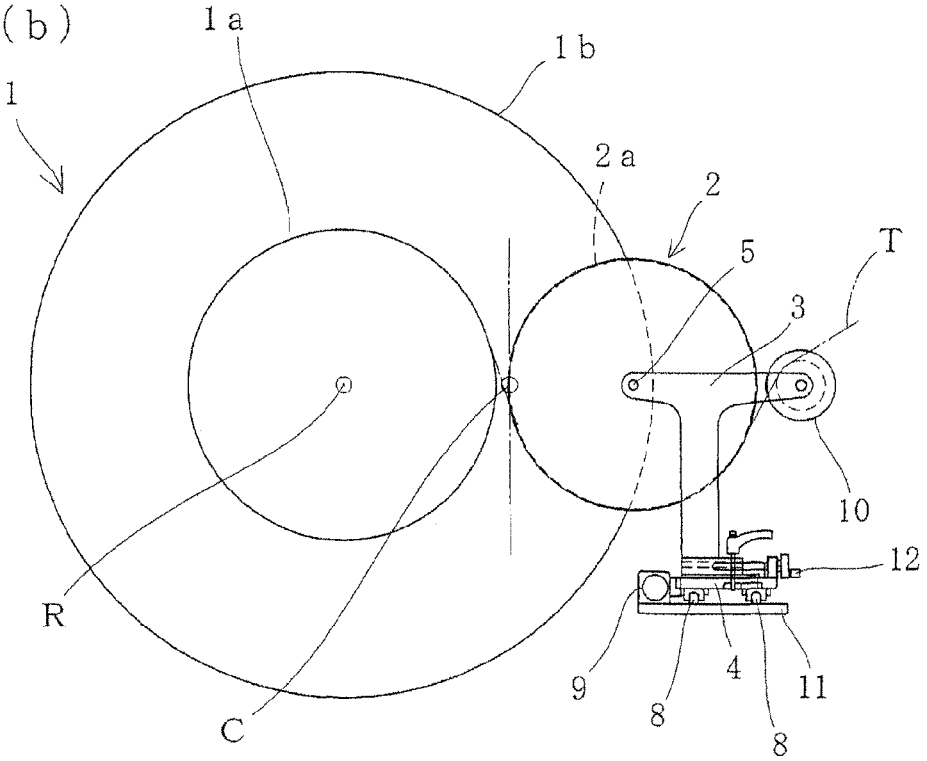
Figure 4:
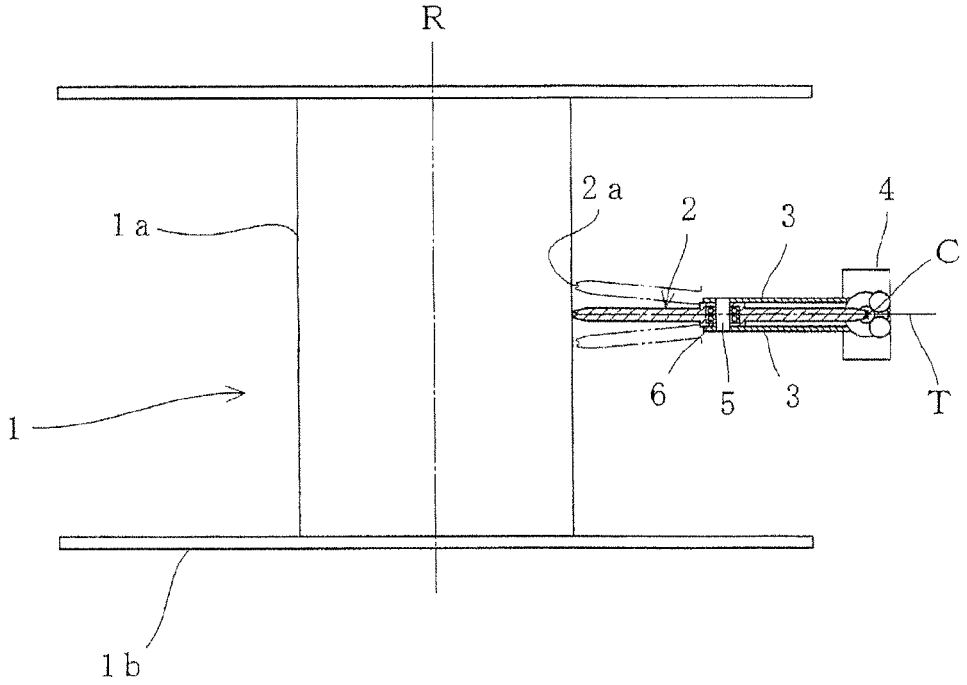
Figure 4 (Prior Art)
FIG. 4 is a plan view showing a main part of a conventional traverse device.

FIG. 1 shows a main part of a traverse device of an embodiment of the invention. In FIG. 1, the reference numeral 1 denotes a reel, 1*a* denotes a reel body, 1*b* denotes a reel flange, 2 denotes a guide roller, 2*a* denotes a guide groove on the outer circumference of the guide roller, 3 denotes a support arm that supports the guide roller, and 4 denotes a support block that supports the support arm 3.

The guide roller 2 is placed near the outer circumference of the reel body 1*a* (preferably at a position spaced about 1 to 20 mm from the bare reel body 1*a* having no winding, more preferably at a position spaced about 1 to 10 mm), and is rotatably supported via a bearing 6 by a roller shaft 5 supported by the support arm 3.

The support arm 3 is supported by the support block 4, and the support position is movable to or from a reel axis R with respect to the support block 4 by operating an adjusting handle 12.

The support block 4 is placed on a movable mount 11 that is movable along a linear guide rail (not shown) formed on a base (not shown) in a direction orthogonal to the axis direction of the reel 1 (direction forward or backward with respect to the reel body 1*a*) using an air cylinder (not shown) for horizontal movement as the drive source. The support block 4 is rotatable on the movable mount 11 along R guides (arc-shaped guide rails) 8 around the center of curvature of the R guides 8 as the center.

The support block 4 is movable and rotatable as described above. When the support block 4 rotates, the guide roller 2 inclines, around the center of curvature of the R guides 8 as the rotation center C, from the position (shown by the solid line in FIG. 1(*a*)) vertical to the reel axis direction to either of positions (shown by dashed-two dotted line in FIG. 1(*a*)) inclined by ±several degrees (about 1 to 10 degrees) in the reel axis direction (up/down direction in FIG. 1(*a*)). Also, when the support block 4 moves forward or backward with respect to the reel body 2*a* with the movement of the movable mount 11, the guide roller 2 moves in a direction in which the roller outer edge comes close to or recedes from the reel body 1*a* on the side near the reel 1.

The positional relationship between the guide roller 2 and the rotation center C (center of curvature of the R guides 8) can be adjusted by the operation of the adjusting handle 12. By turning the adjusting handle 12 to move the support position of the support arm 3 on the support block 4, the position of the support arm 3 with respect to the center of curvature of the R guides 8 changes, and thus the position of the guide roller 2 supported by the support arm 3, i.e., the positional relationship between the guide roller 2 and the rotation center C changes.

In this device, the traverse is performed by moving the reel 1 in the reel axis direction (up/down direction in FIG. 1(*a*)) using an air cylinder (not shown) for reel movement as the drive source. During the traverse, when the guide roller 2 is located in the center in the reel axis direction, for example, that is the midpoint position between the reel flanges 1*b*, the inclining direction of the guide roller 2 is switched, to incline the guide roller 2 in a direction in which the outer edge of the guide roller 2 recedes from the reel flange 1*b* ahead in the traverse direction on the side apart from the reel body 1*a* around the rotation center C (center of curvature of the R guides 8) located near the outer edge of the guide roller 2 on the side near the outer circumference of the reel body 1*b* as the fulcrum. With the guide roller 2 kept inclined in this way, the reel 1 is rotated while being moved in the axial direction, to wind the wire material T fed from a supply reel (not shown) on the reel body 1*a*. Every time the wire material T is wound by one round, the movable mount 11 is moved to move the guide roller 2 in a direction away from the reel body 2 by the distance corresponding to the thickness of the wire material T, and the winding is repeated.

In this device, the position of the rotation center C for inclining the guide roller 2 can be moved, backward from the reel axis R, by the operation of the adjusting handle 12, up to a position displaced about 5 to 10 mm from the center in the width direction of the bottom surface of the guide groove 2*a* on the outer circumference of the guide roller 2 on the side near the reel axis R as the reference. Toward the reel axis R, the position of the rotation center C can be moved up to a position about 5 to 10 mm beyond a position where the distance L between the rotation center C and the bottom surface of the guide groove 2*a* on the outer circumference of the guide roller 2 satisfies $L=(a-w)/(2 \tan \alpha)+h/2$ where a is the width of the guide groove 2*a*, w is the width of the wire material T, h is the depth of the guide groove 2*a*, and $\alpha$ is the inclined angle of the guide roller 2, in a direction vertically crossing the reel axis R. The position of the rotation center C is thus adjustable in response to the thickness of the wire material to be wound.

As described above, the rotation center C is movable toward or backward from the reel axis R from the center in the width direction of the bottom surface of the guide groove 2*a* on the outer circumference of the guide roller 2 on the side near the reel axis R as the reference. In particular, as is apparent from FIG. 2(*a*), when the rotation center C is set to a position where L, a, w, h, and a above satisfy tan $\alpha=\{(a-w)/2\}/(L-h/2)$, i.e., satisfy $L=(a-w)/(2 \tan \alpha)+h/2$, even if the inclining direction of the guide roller 2 is switched from the position shown by the solid line in FIG. 2(*a*) to the position shown by the dashed line, or vice versa, the wire material T only changes from the position shown by the solid line to the position shown by the dashed line, or vice versa, with the center position p of the wire material T being kept unmoved. The wire material T does not deviate in the width direction inside the guide groove 2*a*. Therefore, the traverse pitch does not change.

By contrast, when the rotation center C is set to the center in the width direction of the bottom surface of the guide groove 2*a* on the outer circumference of the guide roller 2 on the side near the reel axis R, for example, if the inclining direction of the guide roller 2 is switched from the position shown by the solid line to the position shown by the dashed line, or vice versa, as shown in FIG. 2(*b*), the wire material T deviates in the width direction in the guide groove 2*a* from the position shown by the solid line to the position shown by the dashed line, or vice versa. The traverse pitch therefore changes by a deviation width s. Note however that if the width w of the wire material is large with respect to the width a of the guide groove, the deviation width s will be small and thus the influence on the pitch will be small.

In the device of this embodiment, the wire material is wound up to the reel flange borders of the reel body 1*a* while wobbling of the wire material T is prevented or reduced with the guide roller 2 being in an inclined position. Therefore, even when the wire material T to be wound is fine, it is unnecessary to reduce the roller width excessively, and thus the guide roller can maintain its necessary strength. Also, since the traverse is performed with the guide roller 2 being inclined at all times except for the switching time, it is unnecessary to move the guide roller 2 forward or backward with respect to the reel body 1*a* in response to the inclination of the guide roller 2. In addition, the inclining direction of the guide roller 2 does not change during one round of traverse. Moreover, by setting the position of the rotation center C to a position satisfying $L=(a-w)/(2 \tan \alpha)+h/2$, the wire material T is prevented from deviating in the width direction of the guide groove 2*a* when the inclining direction of the guide roller 2 is switched at the midpoint position of the reel body 1*a*. The traverse pitch can therefore be kept constant, and control of pitch adjustment is easy. Thus, the regular winding of the wire material can be performed easily and inexpensively.

FIGS. 3(*a*) and 3(*b*) shows an example (another example of the embodiment) where the rotation center C is fixed (although moves in the traverse direction) to the center position in the width direction of the bottom surface of the guide groove 2*a* on the outer circumference of the guide roller 2 on the side near the reel axis R, in particular, in the neighborhood of the roller outer edge on the side near the outer circumference of the reel body 2*a*. In FIGS. 3(*a*) and 3(*b*), the reference numeral 1 denotes a reel, 1*a* denotes a reel body, 1*b* denotes a reel flange, 2 denotes a guide roller, 2*a* denotes a guide groove on the outer circumference of the guide roller, 3 denotes a support arm that supports the guide roller, and 4 denotes a support block that supports the support arm 3.

The guide roller 2 is placed near the outer circumference of the reel body 1*a* (preferably at a position spaced about 1 to 20 mm from the bare reel body 1*a* having no winding, more preferably at a position spaced about 1 to 10 mm), and is rotatably supported via a bearing 6 by a roller shaft 5 supported by the support arm 3.

The support block 4 is mounted on a movable mount 11 that is movable along a linear guide rail (not shown) formed on a base (not shown) in a direction orthogonal to the axis direction of the reel 1 (direction forward or backward with respect to the reel body 1*a*) using an air cylinder (not shown) for horizontal movement as the drive source. The support block 4 is rotatable on the movable mount 11 along an R guide (not shown) around the center of curvature of the R guide as the center.

The support block 4 is movable and rotatable as described above. When the support block 4 rotates, the guide roller 2 inclines, around the center of curvature of the R guide as the rotation center C, from the position (shown by the solid line in FIG. 3(*a*)) vertical to the reel axis direction to either of positions (shown by dashed-two dotted line in FIG. 3(*a*)) inclined by ±several degrees (about 1 to 10 degrees) in the reel axis direction (up/down direction in FIG. 3(*a*)). Also, when the support block 4 moves forward or backward with respect to the reel body 2*a* with the movement of the movable mount 11, the guide roller 2 moves in a direction in which the roller outer edge comes close to or recedes from the reel body 1*a* on the side near the reel 1.

In this device, the traverse is performed by moving the reel 1 in the reel axis direction (up/down direction in FIG. 3(*a*)) using an air cylinder (not shown) for reel movement as the drive source. During the traverse, when the guide roller 2 is located in the center in the reel axis direction (up/down direction in FIG. 3(*a*)), for example, that is the midpoint position between the reel flanges 1*b*, the inclining direction of the guide roller 2 is switched, to incline the guide roller 2 in a direction in which the outer edge of the guide roller 2 recedes from the reel flange 1*b* ahead in the traverse direction on the side apart from the reel body 1*a*, around the rotation center C (center of curvature of the R guide) located near the outer edge of the guide roller 2 on the side near the outer circumference of the reel body 1*b* as the fulcrum. With the guide roller 2 kept inclined in this way, the reel 1 is rotated while being moved in the axial direction, to wind the wire material T fed from a supply reel (not shown) on the reel body 1*a*. Every time the wire material T is wound by one round, the movable mount 11 is moved to move the guide roller 2 in a direction away from the reel body 2 by the distance corresponding to the thickness of the wire material T, and the winding is repeated.

The rotation center C is located at the center in the width direction of the bottom surface of the guide groove 2*a* on the outer circumference of the guide roller 2 on the side near the reel axis R, in particular, in the neighborhood of the roller outer edge on the side near the outer circumference of the reel body 2*a*. In this case, as shown in FIG. 2(*b*), when the inclining direction of the guide roller 2 is switched from the position shown by the solid line to the position shown by the dashed line, or vice versa, the center position p of the wire material T deviates in the guide groove 2*a* in the width direction from the position shown by the solid line to the position shown by the dashed line, or vice versa. The traverse pitch therefore changes by a deviation width s. However, when the wire material is thick and the width a of the guide groove and the width w of the wire material are small, the deviation width s is small, and thus the influence on the pitch is small.

In the device of this embodiment, the wire material is wound up to the reel flange borders of the reel body 1*a* while wobbling of the wire material T is prevented or reduced with the guide roller 2 being in an inclined position. Therefore, even when the wire material T to be wound is fine, it is unnecessary to reduce the roller width excessively, and thus the guide roller can maintain its necessary strength. Also, since the traverse is performed with the guide roller 2 being inclined at all times except for the switching time, it is unnecessary to move the guide roller 2 forward or backward with respect to the reel body 1*a* in response to the inclination of the guide roller 2. In addition, the inclining direction of the guide roller 2 does not change during one round of traverse. Even when the inclining direction of the guide roller 2 is switched at the midpoint position of the reel body 1*a*, the wire material T is prevented from largely deviating in the width direction of the guide groove 2*a*. The traverse pitch can therefore be kept roughly constant, and control of pitch adjustment is comparatively easy. Thus, the regular winding of the wire material can be performed easily and inexpensively.

While the rotation center C for inclining the guide roller 2 is located at the center in the width direction of the bottom surface of the guide groove 2*a* on the outer circumference of the guide roller 2 on the side near the reel axis R in the example shown in FIG. 3, the position of the rotation center C can be set arbitrarily within a range from a position deviated about 5 to 10 mm in a direction away from the reel axis R to a position deviated about 5 to 10 mm in a direction close to the reel axis R, with respect to the center in the width direction of the bottom surface of the guide groove 2*a* on the outer circumference of the guide roller 2 on the side near the reel axis R as the reference.

While the reel 1 is moved to perform the traverse in the above examples of this embodiment, the reel 1 may not be moved but the guide roller 2 may be moved in the reel axis direction, or both the reel 1 and the guide roller 2 may be moved to perform the traverse.

Also, while the wire material to be wound is rectangular in cross section (rectangular wire) in the above examples of the embodiment, it may be circular in cross section (round wire) or of any other shape (deformed wire). Otherwise, it may be a coated wire, a stranded wire, etc.

The present invention is applicable to a variety of wire materials including metal wires such as steel cords, bead wires, and wires for piston rings, coated wires such as electric cables, and other wire materials such as ropes.

REFERENCE SIGNS LIST

1 Reel
- 1*a* Reel body
- 1*b* Reel flange

2 Guide roller
- 2*a* Guide groove

3 Support arm
4 Support block
5 Roller shaft
8 R guide
11 Movable mount
12 Adjusting handle
C Rotation center
R Reel axis

The invention claimed is:

1. A traverse device for winding a wire material onto a reel, the reel comprising a reel body extending along in a reel axis and first and second flanges, one on either end of the reel body, the device comprising:

a guide roller having a guide groove on an outer circumference, the wire material being fed through the guide groove from a position on a side of the guide roller opposite to the reel body to a winding position at the reel body when the device is in use, wherein the winding position is a position along the traverse direction of the reel, a driving source configured and operably connected to move the winding position of the wire material with respect to the reel in a reel axis direction by moving the reel body and the guide roller with respect to one another, wherein the guide roller is placed near an outer circumference of a body of the reel, and inclined with respect to a rotation center located near a roller outer edge on a side near the outer circumference of the reel body, the rotation center forming a fulcrum about which the guide roller inclines when in use, the guide roller being configured to incline in a first direction with respect to the traverse direction between the fulcrum and the first reel flange, to incline in a second direction with respect to the traverse direction between the fulcrum and the second reel flange, and to be oriented in a perpendicular direction with the respect to the reel axis at the position at a midpoint along the reel body between the first and second flanges, wherein the reel or the guide roller is reciprocated in the reel axis direction to move the winding position along the reel body in a direction parallel to the reel axis, wherein the guide roller is placed at is placed at a position spaced 1 to 20 mm from the bare reel body having no winding, wherein every time the wire material is wound by one round, the guide roller is moved in a direction away from the reel body by the distance corresponding to the thickness of the wire material, and wherein the guide roller is inclined in a direction in which the roller outer edge recedes from a nearer reel flange on a side apart from the reel body.

2. The traverse device of claim 1, wherein the rotation center is movable, toward the reel axis, to a position where a distance L between the rotation center and a bottom surface of the guide groove on the outer circumference of the guide roller satisfies $L=(a-w)/(2\tan\alpha)+h/2$, where a is a width of the guide groove, w is a width of the wire material to be wound, h is a depth of the guide groove, and $\alpha$ is an angle of inclination of the guide roller, in a direction vertically crossing the reel axis.

3. A traverse method for winding a wire material onto a reel, the reel comprising a reel body extending along in a reel axis and first and second flanges, one on either end of the reel body, using a traverse device, the method comprising:

feeding the wire material through a guide groove of a guide roller from a position on a side of the guide roller opposite to the reel body to a winding position at the reel body, wherein the winding position is a position along the traverse direction of the reel, moving, via a driving source, the winding position of the wire material with respect to the reel in a reel axis direction by moving the reel body and the guide roller with respect to one another, placing the guide roller near an outer circumference of a body of the reel, so as to be inclined with respect to a rotation center located near a roller outer edge on a side near the outer circumference of the reel body, the rotation center forming a fulcrum about which the guide roller inclines, inclining the guide roller in a first direction with respect to the traverse direction between the fulcrum and the first reel flange, inclining the guide roller in a second direction with respect to the traverse direction between the fulcrum and the second reel flange, and orienting the guide roller in a perpendicular direction with the respect to the reel axis at the position at a midpoint along the reel body between the first and second flanges, reciprocating the reel or the guide roller in the reel axis direction to move the winding position along the reel body in a direction parallel to the reel axis to wind the wire material on the reel, wherein the guide roller is placed at a position spaced 1 to 20 mm from the bare reel body having no winding, wherein every time the wire material is wound by one round, the guide roller is moved in a direction away from the reel body by the distance corresponding to the thickness of the wire material, and wherein the guide roller is inclined in a direction in which the roller outer edge recedes from nearer reel flange on the side apart from the reel body.

4. A traverse method of claim 3, further comprising setting the rotation center to a position where the distance L between the rotation center and the bottom surface of the guide groove on the outer circumference of the guide roller satisfies $L=(a-w)/(2 \tan \alpha)+h/2$ where a is the width of the guide groove on the outer circumference of the guide roller, w is the width of the wire material to be wound, h is the depth of the guide groove, and $\alpha$ is the inclined angle of the guide roller.

* * * * *